United States Patent [19]

Shioi

[11] 4,387,730

[45] Jun. 14, 1983

[54] VANITY CASE

[75] Inventor: Yuji Shioi, Tokyo, Japan

[73] Assignee: Yoshida Industry Co., Ltd., Tokyo, Japan

[21] Appl. No.: 290,968

[22] Filed: Aug. 7, 1981

[30] Foreign Application Priority Data

Mar. 23, 1981 [JP] Japan ..... 56-38911

[51] Int. Cl.[3] ..... A45D 33/00

[52] U.S. Cl. ..... 132/83 R

[58] Field of Search ..... 132/83

[56] References Cited

U.S. PATENT DOCUMENTS 1,501,130 7/1924 Morrison ..... 132/83 R 4,276,893 7/1981 Enomoto ..... 132/83 R

*Primary Examiner*—G. E. McNeill

*Attorney, Agent, or Firm*—Wenderoth, Lind & Ponack

[57] ABSTRACT

In a vanity case, such as a compact case, comprising a receptacle member and a hinged cover member arranged to be latched with each other by snap action, a recess is formed in one of the members in which a slider element having an enlarged outer end is provided in such a manner that when the slider element is pushed inwardly, the enlarged outer end exerts such a force as to separate the one member from the other member by releasing the latching therebetween. The slider element is urged forwardly by a spring member provided in the recess.

4 Claims, 10 Drawing Figures

VANITY CASE

BACKGROUND OF THE INVENTION

This invention relates to an improvement of a vanity case having a receptacle member and a cover member hinged with each other and arranged to be latched by snap engagement of an elastic latch tongue.

In a known vanity case, such as a compact case, of the type set forth above, the elastic latch tongue as well as protrusion engagable therewith are integrally formed with the cover and receptacle members by plastic molding. These elastic latch tongue and the protrusion have to be formed to very precise dimensions, because, if the engagement between the latch tongue and the protrusion is too weak, the cover member of the vanity case will open accidentally. On the other hand, if the engagement therebetween is too firm, a relatively strong force has to be exerted to open the cover member, thereby causing trouble to the user. Accordingly, when molding the cover and receptacle members, the utmost attention has to be paid to the accuracy of the dimensions of the latch tongue and protrusion. However, inferior vanity cases having defective dimensions of the latch tongue and protrusion inevitably are formed at a relatively high percentage.

As an improvement of the defects set forth above, it has been proposed to provide a slider element which releases the snap engagement between the latch tongue and the protrusion when pushed in the horizontal direction. This structure has remarkable advantages that the above-mentioned engagement can be released very easily by a small pushing force, so that the latch tongue as well as the protrusion can be formed to engage firmly with each other without the necessity of high dimensional accuracy as required in the conventional vanity case. However, in the above proposed vanity case, the slider element is loosely fitted in a guide cavity or recess in the receptacle member or cover member, so that the slider element becomes shaky in the recess after releasing the engagement of the cover member from the receptacle member. Such a shaky movement of the slider element deteriorates a high-grade image of the vanity case.

Accordingly, an object of the present invention is to improve the above drawbacks and, thereby, to provide a vanity case in which a cover member can be opened very easily by a slider element without any shaky movement thereof in a recess in a receptacle member or cover member.

Another object of the present invention is to provide a vanity case of the type set forth above which is very simple in assembly and reliable in operation.

SUMMARY OF THE INVENTION

A vanity case according to the present invention comprises a receptacle member for containing cosmetic material therein, a cover member hinged with the receptacle member at the rear end thereof, and a latching means engagable by snap action when the receptacle member is closed by the cover member. One of the cover and receptacle members has a recess exending therein from the front end thereof, into which a slider element is slidably inserted. An outer end portion of the slider element is exposed outside of the recess and is enlarged and arranged to locate closely adjacent to the front end of the other of the cover and receptacle members in such a manner as to release the engagement of the latching means when the slider element is pushed inwardly. The improvement of the present vanity case comprises a spring member provided in the recess for normally urging the slider element outwardly.

Preferably, the recess has an arc-shaped wall therein which is curved outwardly toward the slider element. The slider element has a pair of arc-shaped arms at both side ends thereof in which a leaf spring is fitted. The leaf spring is bent along the arc-shaped wall, thereby urging the slider element outwardly.

Further objects and features of the present invention will become apparent from the detailed description of preferred embodiments thereof when taken in conjunction with the accompanying drawings.

DETAILED DESCRIPTION OF THE INVENTION

Figure 1:
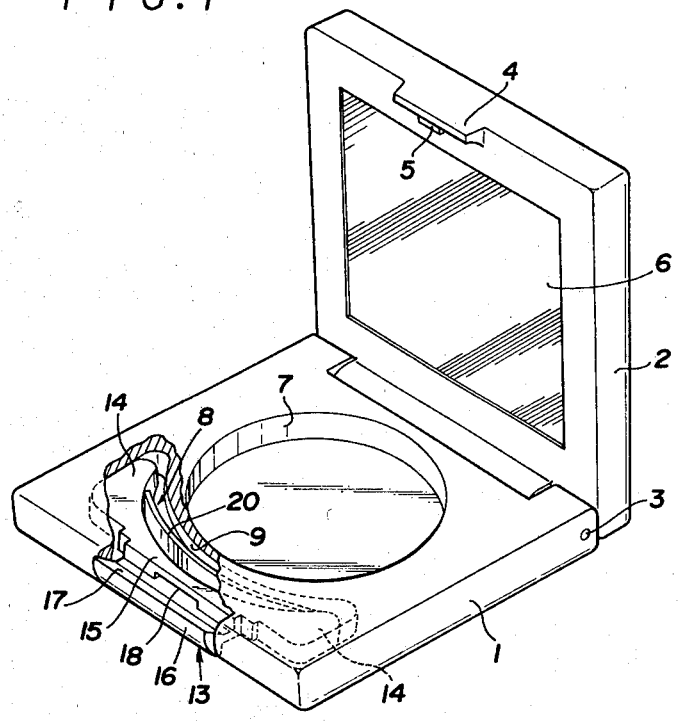
FIG. 1 is a partially sectioned perspective view showing a vanity case according to a first embodiment of the present invention.

Referring now to a first embodiment of the present invention shown in FIGS. 1 to 4, a plastic vanity case, i.e. compact case, of the present invention comprises a receptacle member 1 and a cover member 2 connected with each other by a hinge 3 along the rear ends thereof. The cover member 2 has an integral nose 4 depending from the front end thereof. The nose 4 has an elastic latch tongue 5 on the inner surface thereof. The cover member 2 also has a mirror 6 attached on the inner surface thereof.

The receptacle member 1 has a circular concave 7 for containing cosmetic material therein. The bottom front part 8 of the receptacle member 1 is recessed as shown by dotted lines in FIG. 2. This recess 8 comprises an arc-shaped wall 9 defining an annular wall of the circular concave 7, a pair of side walls 10, and front walls 11. The central front end of the receptacle member 1 is cut out to provide an open gate 12 leading to the bottom recess 8 set forth above.

Inserted into the recess 8 from the bottom side of the receptacle member 1 is a plastic slider element 13 which has a similar shape as but smaller than the recess 8. That is, the slider element 13 has extending from of center part 15 thereof a pair of arc-shaped arms 14 which are loosely fitted into the recess 8. The slider element 13 also comprises a head portion 16 integrally formed with the center part 15 thereof and forwardly extending therefrom. It is formed in such a manner that when the slider element 13 is inserted into the recess 8, the head portion 16 thereof is exposed outside of the open gate 12 in the receptacle member 1. The head portion 16 of the slider element 13 has an inclined upper surface section 17 and a cavity portion 18, the function of which shall be described hereinafter. The arms 14 of the slider element 13 have grooves 19 at the underside thereof in which both ends of a leaf spring 20 are snugly fitted such that the leaf spring 20 can be bent forwardly and rearwardly.

Figure 3:
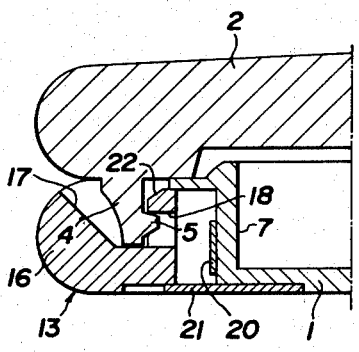
FIG. 3 is a sectional view showing a part of the vanity case in a latched position.
Figure 4:
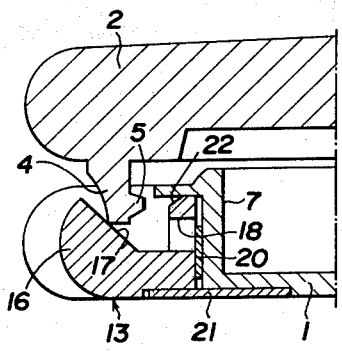
FIG. 4 is a sectional view showing the same part of the vanity case in an unlatched position.
Figure 2:
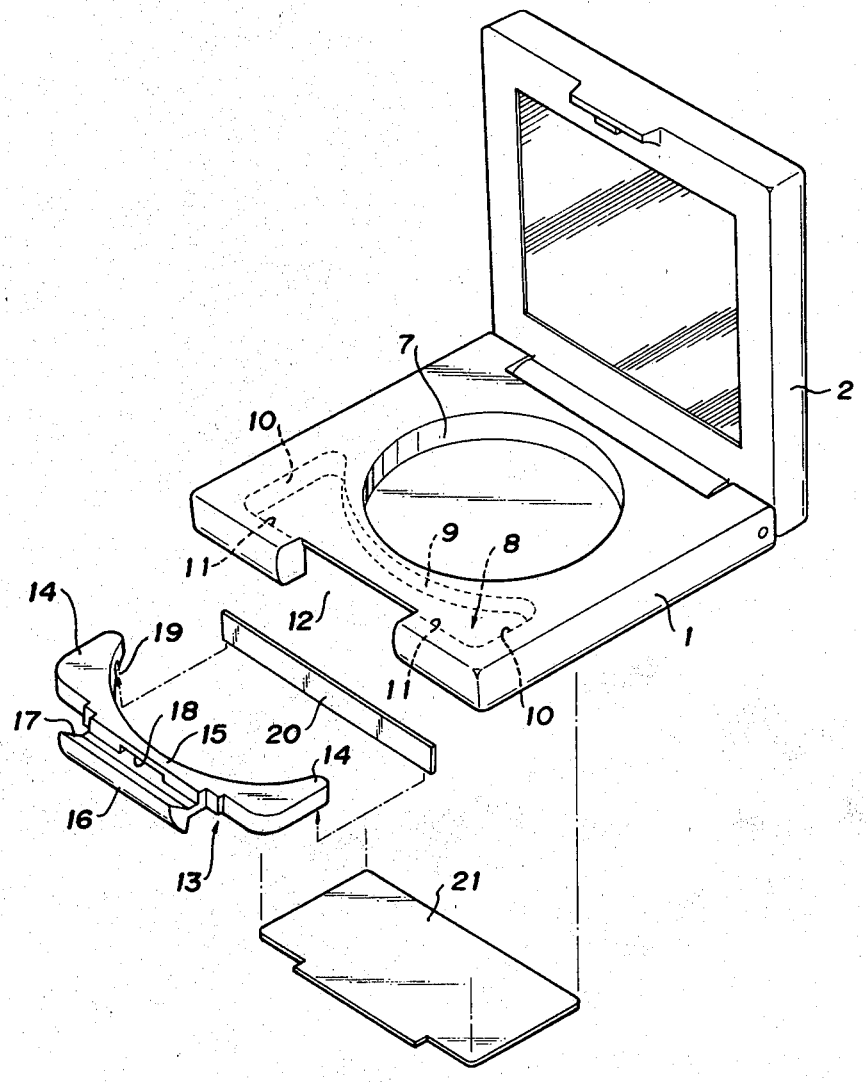
FIG. 2 is a partially exploded perspective view of the same vanity case as shown in FIG. 1.

For assembly of the slider element 13, the leaf spring 20 is first fitted to the grooves 19 of the arms 14 and then the slider element 13 is inserted into the recess 8 from the bottom side of the receptacle member 1. At this time, the leaf spring 20 is slightly bent forwardly along the curvature of the arc-shaped wall 9 of the recess 8 for smooth insertion of the slider element 13 into the recess, so that, after insertion, the bent leaf spring 20 contacts the arc-shaped wall 9 of the reccess and urges the slider element 13 forwardly. For completion of the assembly, a closure plate 21 is fitted to the bottom of the receptacle member 1 to close the recess 8. In the state thus assembled, the head portion 16 of the slider element 13 is exposed outside of the open gate 12 in the receptacle member 1 in such a manner that when the cover member 2 is closed, the latch tongue 5 on the nose 4 acts upon the inclined front edge 22 at the center part 15 of the slider element 13 to move the latter rearwardly against the leaf spring 20 and is then engaged with the cavity 18. After engagement into the cavity 18, the slider element 13 is moved forwardly by the leaf spring 20 and is latched as shown in FIG. 3. At this latched position, the inclined upper surface section 17 at the head portion 16 of the slider element 13 is located closely adjacent to the nose 4 of the cover member 2.

From this latched position, when the head portion of the slider element 13 is pushed inwardly, i.e. rearwardly, the latch tongue 5 on the nose 4 of the cover member 2 is disengaged from the cavity 18 and then the inclined upper surface section 17 on the slider element pushes up the nose 4. Therefore, after removing the pushing force from the slider, although the slider element returns to the original position by the action of the leaf spring 20, the latch tongue 5 of the nose 4 cannot be engaged with the cavity 18 of the slider element any more. Then, a user can open the cover member 2 at any desired angle.

As will be understood from the description of the first embodiment, there is no shaky movement of the slider element 13 even after releasing the latching engagement of the cover member 3 due to the spring action of the leaf spring 20. The arc-shaped wall 9 defining the circular concave 7 for the cosmetic material is used conveniently to bend the leaf spring 20 for affording the spring action.

Figure 5:
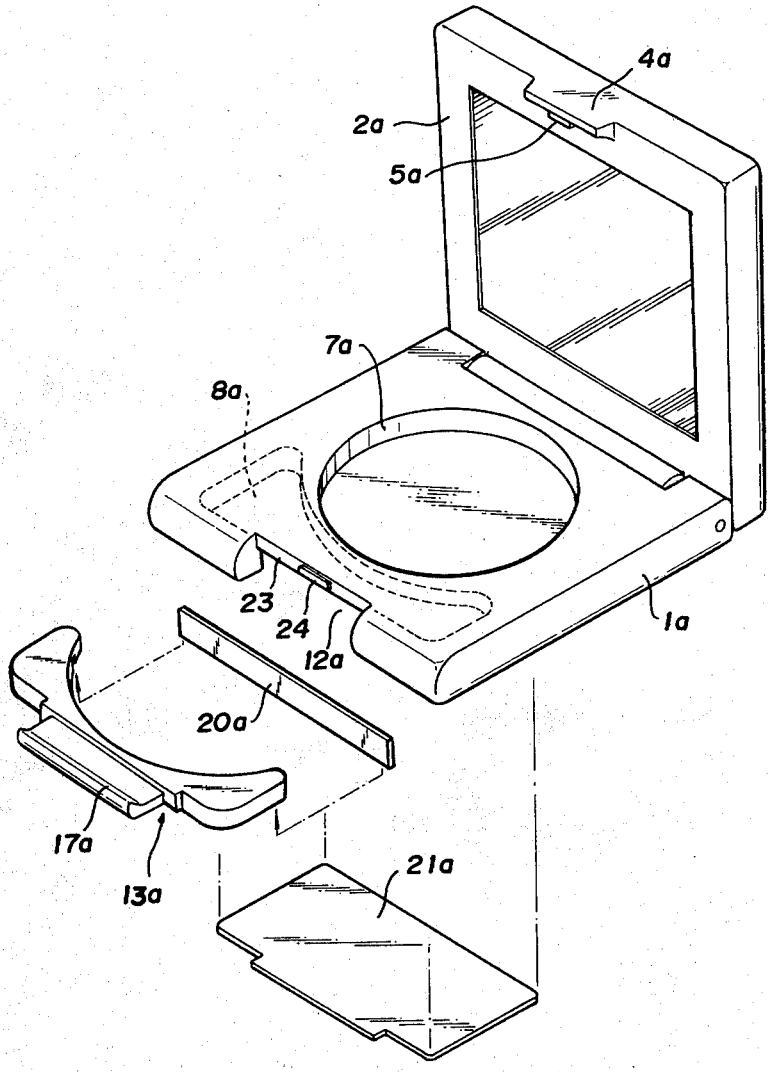
FIG. 5 is a partially exploded perspective view of a vanity case according to a second embodiment of the present invention.
Figure 6:
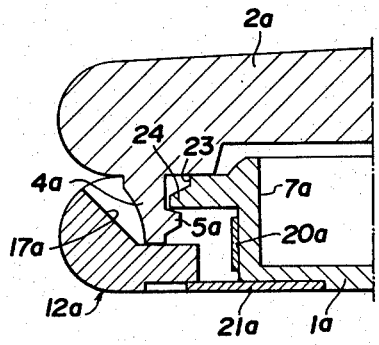
FIG. 6 is a sectional view showing a part of the vanity case of the second embodiment in a latched position.
Figure 7:
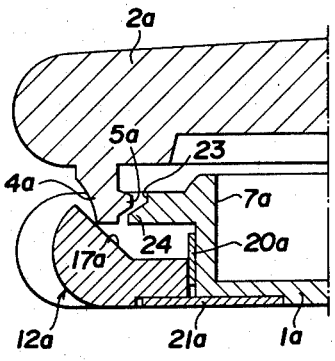
FIG. 7 is a sectional view showing the same part of the vanity case of the second embodiment in an unlatched position.

Referring now to a second embodiment of the present invention shown in FIGS. 5 to 7, a receptacle member **1*a* has an open gate 12*a* smaller than that of the first embodiment. The central front end wall 23 of the receptacle member 1*a* defining the open gate 12*a* has a protrusion 24 in such a manner that when the cover member 2*a* is closed over the receptacle member 1*a*, the latch tongue 5*a* on the nose 4*a* of the cover member 2*a* is engaged with the protrusion 24 as shown in FIG. 6. Thus, in the second embodiment of the present invention, a slider element 12*a* has no cavity 18** of the type provided in the first embodiment. Other structures of the second embodiment are substantially the same as those shown in the first embodiment and, therefore, the same reference numerals are adopted to designate the same parts with the addition of "a".

From the latching position shown in FIG. 6, when the slider element **13*a* is pushed inwardly against the leaf spring 20*a*, the inclined upper surface section 17*a* of the slider element 13*a* pushes up the nose 4*a* of the cover member 2*a*, thereby releasing the engagement of the latch tongue 5*a* from the protrusion, as shown in FIG. 7**, to allow free opening of the cover member to desired angle.

Figure 9:
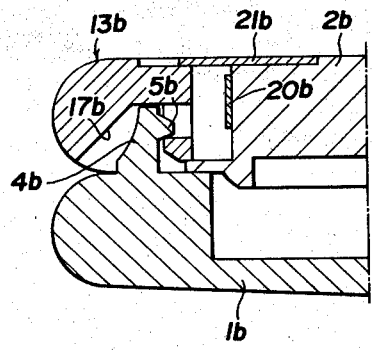
FIG. 9 is a sectional view showing a part of the vanity case of the third embodiment in a latched position.
Figure 10:
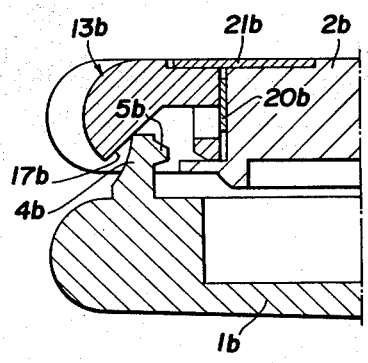
FIG. 10 is a sectional view showing the same part of the vanity case of the third embodiment in an unlatched position.
Figure 8:
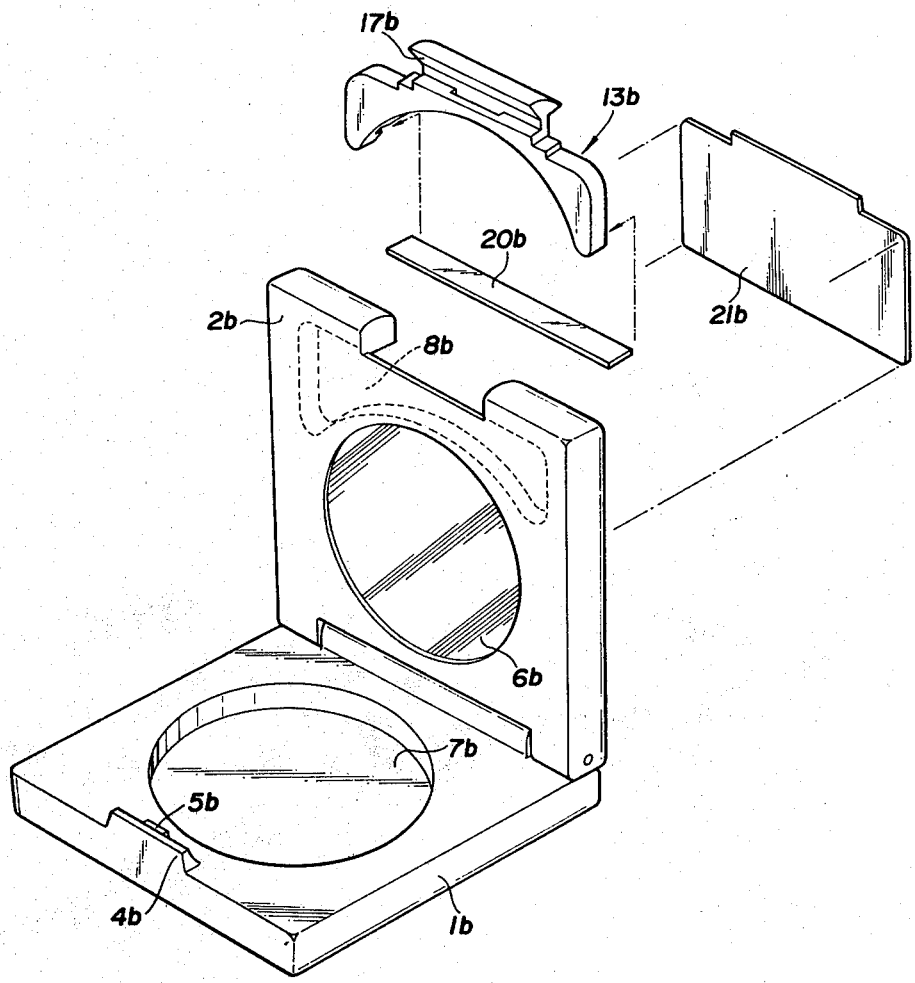
FIG. 8 is a partially exploded perspective view of a vanity case according to a third embodiment of the present invention.

Reference is now made to a third embodiment of the present invention shown in FIGS. 8 to 10 wherein the same reference numerals have been adopted to the same parts with the addition of "b" as those shown in the first embodiment. In this third embodiment, a slider element **13*b* provided with a leaf spring 20*b* is slidably fitted in a recess 8*b* formed in the cover member 2*b*. On the other hand, a latch tongue 5*b* engagable with the slider element 13*b* is provided on a nose 4*b* which extends vertically from the front edge of a receptacle member 1*b*. The structures of the recess 8*b* and the slider element 13*b*** are just the same as those of the first embodiment. Also, the latching and unlatching operations are substantially the same as those of the first embodiment. However, this third embodiment has an advantage for the opening operation of the cover member, which can be done by pushing the slider element inwardly by a thumb and opening the cover member by the same thumb without changing the holding position of the vanity case.

Although the present invention has been described with reference to preferred embodiments thereof, many modifications and alterations may be made within the spirit of the present invention.

What is claimed is:

1. A vanity case comprising:

a receptacle member for containing cosmetic material;

a cover member;

said receptacle and cover members being hinged together at respective rear ends thereof;

a latch tongue integrally and unitarily formed with one of said cover and receptacle members;

a recess formed in the other of said cover and receptacle members and extending therein from the front end thereof;

said recess being partially defined by an arc-shaped wall which is curved outwardly toward said front end;

a slider element slidably disposed in said recess and having a pair of arc-shaped arms and an outer end portion, said outer end portion being positioned closely adjacent to the front end of said one member when said cover member is in a closed position over said receptacle member, said outer end portion including means for, upon inward movement of said slider element, forcing said one member away from said other member;

said slider element having therein an inwardly extending cavity, said latch tongue of said one member being received in said cavity for engagement therewith when said slider element is in an outermost position thereof, and said latch tongue being moved out of said cavity by said inward movement of said slider element; and a leaf spring provided between said arms of said slider element and bent by said arc-shaped wall for urging said slider element outwardly to normally hold the same in said outermost position.

2. A vanity case as claimed in claim 1, wherein said latch tongue is formed on a nose projecting from the front end of said one member, said nose extending into said recess, and said forcing means comprises a surface of said outer end portion of said slider element, said surface being inclined to the direction of movement of said slider element and acting on said nose by said inward movement of said slider element.

3. A vanity case as claimed in claim 2, wherein said nose is projected from the front end of said cover member, said recess is formed in said receptacle member, and said arc-shaped wall defining said recess is formed by a circular concave for receiving the cosmetic material.

4. A vanity case as claimed in claim 2, wherein said nose is projected from the front end of said receptacle member, and said recess is formed in said cover member.

* * * * *